US008763548B2

(12) United States Patent
Swetish et al.

(10) Patent No.: US 8,763,548 B2
(45) Date of Patent: Jul. 1, 2014

(54) SCUPPER PLUG WITH ONE-WAY VALVE

(75) Inventors: Thomas R. Swetish, Bellingham, WA (US); Gary Warren Seaman, Ferndale, WA (US)

(73) Assignee: Johnson Outdoors Inc., Racine, WI (US)

( * ) Notice: Subject to any disclaimer, the term of this patent is extended or adjusted under 35 U.S.C. 154(b) by 275 days.

(21) Appl. No.: 13/310,878

(22) Filed: Dec. 5, 2011

(65) Prior Publication Data

US 2012/0137948 A1 Jun. 7, 2012

Related U.S. Application Data

(60) Provisional application No. 61/420,397, filed on Dec. 7, 2010.

(51) Int. Cl.
*B63B 13/00* (2006.01)

(52) U.S. Cl.
USPC ..... 114/182

(58) Field of Classification Search
USPC ..... 114/182, 183 R, 184, 185, 183 A; 137/854, 515.5, 454.2
See application file for complete search history.

(56) References Cited

U.S. PATENT DOCUMENTS

| | | | | |
|---|---|---|---|---|
| 2,649,277 | A * | 8/1953 | Blackford | 137/515.5 |
| 2,884,888 | A | 5/1959 | Pujol | |
| 3,565,107 | A | 2/1971 | Bunch | |
| 3,572,280 | A * | 3/1971 | Monson | 114/184 |
| 4,748,999 | A | 6/1988 | Delwiche | |
| 5,385,108 | A | 1/1995 | Thompson | |
| 5,870,965 | A | 2/1999 | Hansen | |
| 6,604,481 | B2 | 8/2003 | Johnston | |
| 6,615,760 | B1 * | 9/2003 | Wise et al. | 114/197 |
| 6,754,915 | B2 | 6/2004 | Mistarz | |
| 6,973,891 | B1 | 12/2005 | Warner | |
| 2003/0116073 | A1 | 6/2003 | Johnston | |

FOREIGN PATENT DOCUMENTS

| | | | |
|---|---|---|---|
| CA | 418104 | A | 2/1944 |
| CA | 901393 | A | 5/1972 |
| GB | 1140554 | | 1/1969 |
| GB | 1187553 | | 4/1970 |
| JP | 58085781 | A | 5/1983 |
| JP | 61200082 | A | 9/1986 |
| JP | 2005319831 | A | 11/2005 |
| JP | 2007-191072 | A | 8/2007 |
| WO | WO 02/02881 | A1 | 1/2002 |
| WO | WO 2010/120200 | A1 | 10/2010 |

* cited by examiner

*Primary Examiner* — Daniel V Venne
*Assistant Examiner* — Anthony Wiest
(74) *Attorney, Agent, or Firm* — Reinhart Boerner Van Deuren P.C.

(57) ABSTRACT

A scupper plug with a one-way valve is provided. The scupper plug permits one-way flow of water through a scupper drain so that water will drain through the scupper drain but not flow back up through the drain and into the passenger area of a water vessel. The scupper plug has a frame that carries a valve structure. A valve member is mounted to the valve structure. The valve member sealingly engages the frame to form a seal therewith.

11 Claims, 6 Drawing Sheets

SCUPPER PLUG WITH ONE-WAY VALVE

CROSS-REFERENCE TO RELATED PATENT APPLICATION

This patent application claims the benefit of U.S. Provisional Patent Application No. 61/420,397, filed Dec. 7, 2010, the entire teachings and disclosure of which are incorporated herein by reference thereto.

FIELD OF THE INVENTION

This invention generally relates to watercraft drainage systems and particularly to scupper drains of kayaks and similarly sized vessels.

BACKGROUND OF THE INVENTION

Recreational watercrafts such as kayaks continue to grow in popularity. As such, there have been various efforts to maximize the safety, comfort, and control of these watercrafts to accommodate various uses and operating environments. One particular type of recreational watercraft, the sit on top kayak, has gained popularity and recognition for enhanced safety.

As its name suggests, the sit on top kayak differs from other kayaks in that the user sits in a depression forming a seating area on top of the kayak, as opposed to sitting inside, as in traditional kayaks. As a result, it is generally easier for a user to quickly escape a capsized sit on top kayak than it is to escape a capsized sit inside kayak because the user does not have to attempt to escape from an interior of the kayak while underwater.

Unfortunately, the depression forming the seating area can easily collect water therein due to its open design, thereby creating an uncomfortable ride. To reduce the amount of water that collects within this depression, sit on top kayaks often incorporate drains called scuppers that allow water to drain out of the depression thereby keeping the seating area generally dry. The scupper is typically a tube that extends from the depression, through the hull of the kayak, to an opening on an underside thereof.

Unfortunately, when the sit on top kayak is overloaded by personnel or gear, water can enter the seating area through the scupper, thereby negating the purpose of the scupper entirely. To solve this problem, the scupper can be plugged, but this has the undesirable effect of prohibiting the scupper from draining any water that later enters the depression.

In view of the above, it is therefore desirable for a scupper plug that alleviates the above noted deficiencies. The invention provides such a scupper plug. These and other advantages of the invention, as well as additional inventive features, will be apparent from the description of the invention provided herein.

BRIEF SUMMARY OF THE INVENTION

In one aspect, embodiments of the invention provide a scupper plug that allows water to drain out of a scupper drain, while preventing water from flowing up through the scupper drain and into the seating area of a kayak or similar vessel. A scupper plug according to this aspect includes a frame that carries a valve structure. The valve structure carries a valve member. The valve member is configured to allow one way flow of water through the scupper plug.

In another embodiment, the frame has a plurality of openings that allow water to flow from an exterior of the frame into an interior thereof. The valve structure also has a plurality of openings that allow water to flow from the interior of the frame and out of the scupper plug.

In another embodiment, the valve member is generally disc shaped with a retaining feature extending therefrom. The retaining feature is received by an aperture of the valve structure. The valve member is configured to deflect relative to the valve structure to allow water to flow through the scupper plug in a first direction. The valve member is also configured to sealingly engage the valve structure frame and prevent water to flow through the scupper plug in a second direction opposite the first direction. As a result, the scupper plug facilitates drainage of water in the seating area of a kayak, while also preventing ingress of water into the seating area.

In another embodiment, the seal member is carried in a channel formed in a sidewall of the frame. The seal member is partially exposed from the channel and is configured to sealingly engage an inner periphery of the scupper drain. In another embodiment, the seal member is an o-ring.

In another embodiment, the frame includes a plurality of ribs that extend from a sidewall thereof. The ribs define an outer periphery of the scupper plug that is substantially similar in dimension to the inner periphery of the scupper drain. As a result, the scupper plug has minimal radial play relative to the scupper drain when installed therein.

In another aspect, a scupper plug for a watercraft is provided. An embodiment of the scupper plug includes a frame having an internal cavity and at least one opening allowing for fluid to pass from an exterior of the frame to the internal cavity. The scupper plug also includes a valve structure mounted within the internal cavity of the frame. A valve member is mounted to the valve structure. The valve member is operable to permit fluid to flow from the internal cavity to the exterior of the frame in a draining direction and prohibit fluid to enter the internal cavity from the exterior of the frame in a direction opposite the draining direction.

In certain embodiments, the at least one opening of the frame includes a plurality of openings formed in a sidewall of the frame. The plurality of the openings are equally spaced about a circumference of the frame. The frame has first and second axial ends. The first axial end has an opening formed therein. The second axial end is closed. The sidewall extends between the first and second axial ends.

In certain embodiments, the valve structure is removable from the frame and includes a mounting feature and a locating feature. The mounting feature is received in one of the plurality of openings formed in the sidewall of the frame when the valve structure is installed within the internal cavity of the frame. The locating feature is formed by an abutment rib. The abutment rib includes a first axial abutment face. The frame includes a second axial abutment face. The first axial abutment face abuts the second abutment face when the valve structure is installed within the internal cavity of the frame.

In certain embodiments, the mounting feature is received within one of the plurality of openings such that the valve structure is restricted from axial movement relative to the frame in the draining direction when the valve structure is installed within the internal cavity of the frame. The first and second axial abutment faces abut to restrict movement of the valve structure relative to the frame in the direction opposite the draining direction when the valve structure is installed within the internal cavity of the frame.

In yet another aspect, a scupper plug for a watercraft is provided. An embodiment of the scupper plug according to this aspect includes a frame having an internal cavity and an opening in an axial face of the frame. A first sealing member is mounted to and circumscribes the frame and is configured to form a radial seal with an inner periphery of a scupper drain. A removable valve structure is positioned within the internal cavity of the frame such that a flow path extends from the internal cavity and through the valve structure. A second sealing member is carried by the valve structure. The second sealing member is configured to form an axial seal against an axial face of the frame to selectively close the flow path.

In certain embodiments, the first sealing member is partially received within a seal carrying groove formed in an outer periphery of the frame. The first sealing member extends radially outward from the seal carrying groove. In a subsidiary embodiment, the first sealing member is an O-ring having a generally circular cross-sectional profile. In another subsidiary embodiment, the first sealing member is a gasket having a generally non-circular cross-sectional profile.

In certain embodiments, the frame has a first axial end and a second axial end. The first sealing member is mounted to the frame adjacent the first axial end.

In certain embodiments, the valve structure includes a first end, a second end, and a sidewall extending between the first and second ends. The first end includes a valve member receiving aperture and a plurality of draining apertures surrounding the valve member receiving aperture. The flow path extends from the internal cavity through the plurality of draining apertures.

In certain embodiments, the valve member is generally disc-shaped and includes a valve member retaining feature extending generally perpendicular to a sealing face of the valve member. The valve member receiving aperture receives the valve member retaining feature such that the valve member selectively closes the flow path by preventing fluid flow in a draining direction through the plurality of draining apertures.

In certain embodiments, the sidewall includes a plurality of open-ended slots formed therein such that the sidewall is resiliently flexible inward to install and remove the valve structure from the frame.

In yet another aspect, a method of preventing fluid ingress through a scupper drain and into a seating area of a watercraft is provided. An embodiment of this method includes positioning a scupper plug having a valve member within the scupper drain. The valve member is configured to prevent fluid flow through the scupper drain in a first direction and allow fluid flow through the scupper drain in a second direction opposite the first direction.

In certain embodiments, the step of positioning includes sealing the engaging and inner-periphery of the scupper drain with a radial seal member and positioning a sealing face of the valve member such that it is normal to a direction of fluid flow through the scupper drain.

In certain embodiments, the step of positioning includes positioning the scupper plug within the scupper drain such that it is manually removable from the scupper drain by hand through an opening of the scupper drain.

In yet another aspect, a recreational watercraft is provided. A recreational watercraft according to this aspect includes a body with at least one scupper drain formed therein. The scupper drain fluidly communicates a seating area of the watercraft with an exterior of the body. A scupper plug is positioned within the scupper drain. The scupper plug is configured to allow fluid to drain from the seating area through the scupper drain and prevent fluid to flow into the seating area through the scupper drain.

In certain embodiments, the scupper plug is removable from the scupper drain. The scupper plug includes a first sealing member and a second sealing member. The first sealing member radially seals against an inner-periphery of the scupper drain. The second sealing member axially seals against an axial face of a portion of the scupper plug to close a flow path through the scupper drain in one direction.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
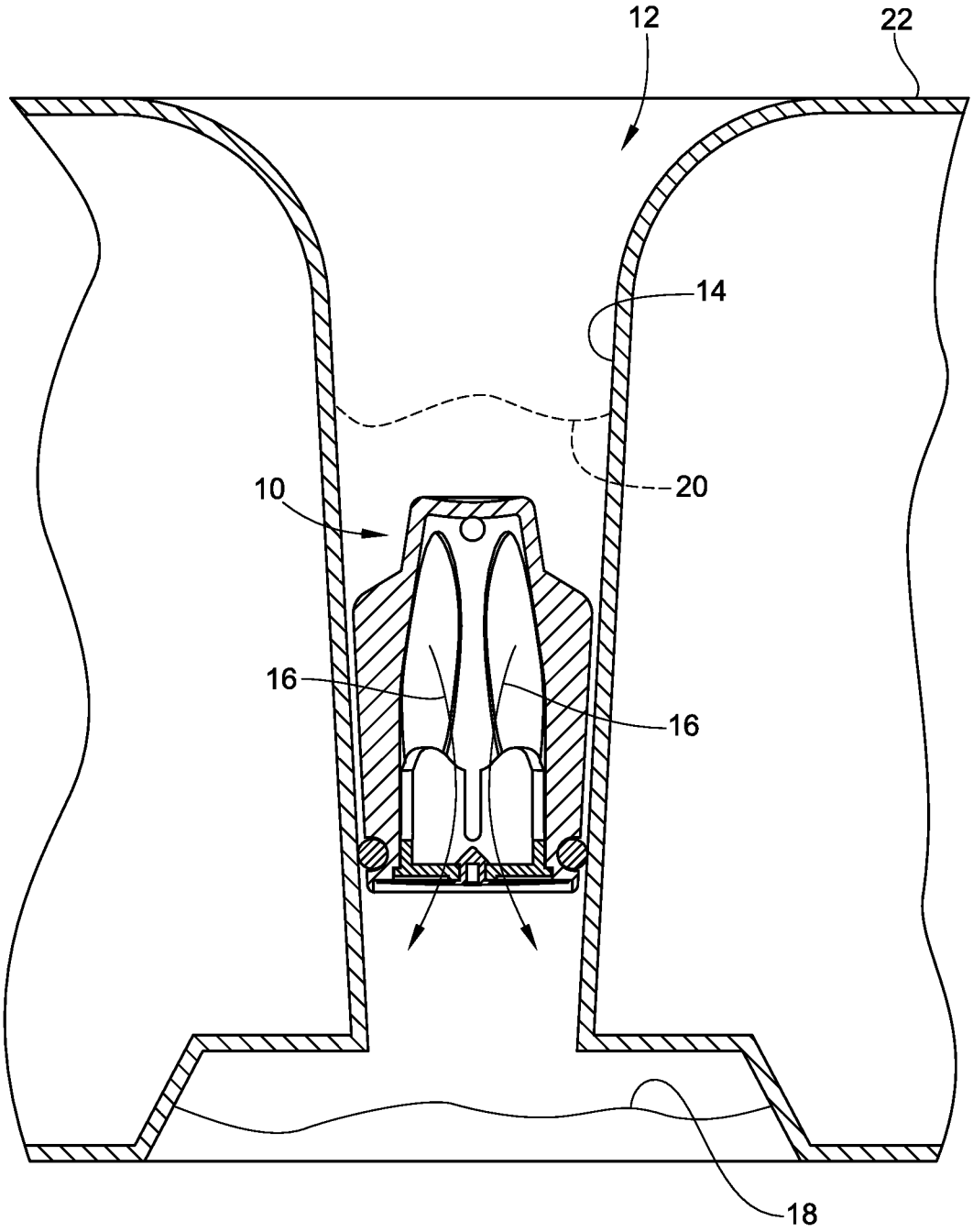
FIG. 1 is an exemplary embodiment of a scupper plug according to the teachings of the present invention installed in a scupper drain.

Turning now to the drawings, FIG. 1 illustrates a scupper plug 10 within a scupper drain 12 of a sit on top kayak 22. While the following description will utilize such an exemplary environment in describing various features of embodiments of the invention, such description should be taken by way of example only. Indeed, embodiments of the invention can be incorporated into drainage systems of a variety of water vessels, and the invention is therefore not limited to the particular scupper drain 12 design illustrated.

With reference to FIG. 1, the scupper plug 10 seals against an inner-periphery 14 of the scupper drain 12. As will be explained in greater detail in the following, the scupper plug 10 allows water to drain through the scupper drain 12 generally in a draining direction illustrated by arrows 16. Indeed, water trapped within the drain as represented by water line 20 will drain along the draining direction 16 through an internal cavity of the scupper plug 10, and out an end thereof to equalize with the water level surrounding the exterior of the kayak 22, represented by water line 18. However, water generally may only flow through the scupper plug 10 along direction lines 16. As a result, the scupper plug 10 overcomes existing problems in the art by preventing the water from flowing back up through the scupper drain 12 by functioning as a plug, but additionally allows water to drain from the scupper drain 12 so as to not negate the purpose of the scupper drain 12 entirely.

Figure 2:
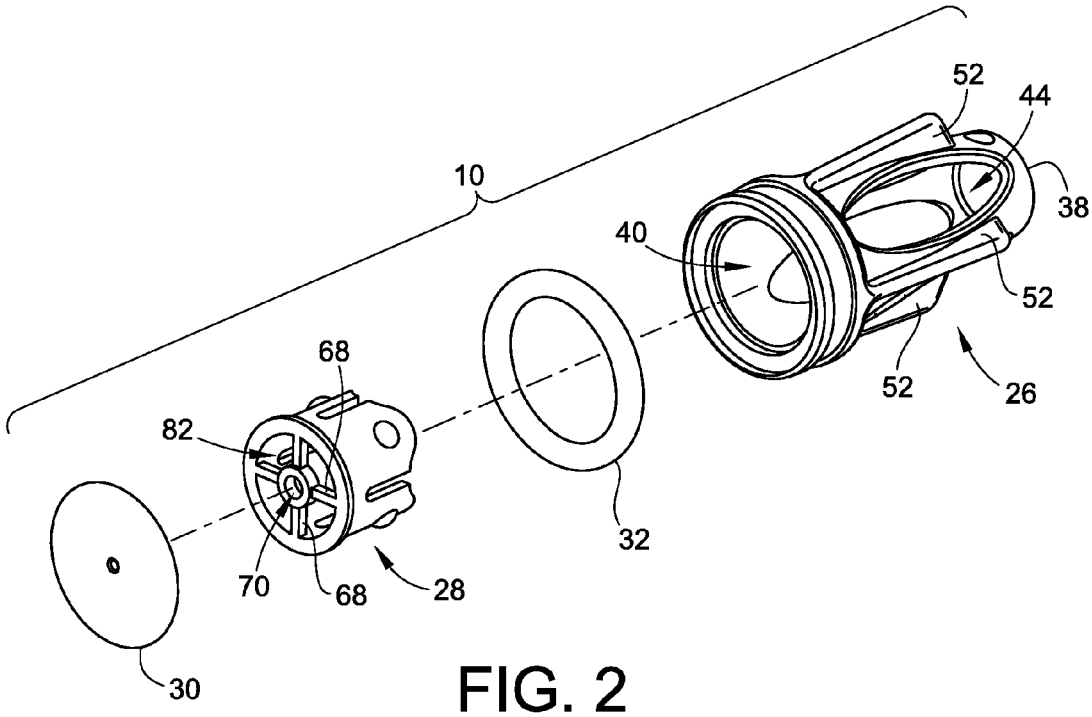
FIG. 2 is a perspective exploded view of the scupper plug of FIG. 1.

With reference now to FIG. 2, an embodiment of the scupper plug 10 includes a frame 26 that carries a valve structure 28 with a valve member 30 mounted thereto. Although illustrated as separate components, it will be recognized that the frame 26 and valve structure 28 can be provided by a single component in other embodiments. However, utilizing separate components for the valve structure 28 and the frame 26 generally makes it less difficult to manufacture the scupper plug 10.

The frame 26 also carries a seal member 32. The seal member 32 sealingly engages the inner-periphery 14 of the scupper drain 12 as illustrated in FIG. 1. While the seal member 32 is generally illustrated as an o-ring, it is recognized that various other types of seal members can be used, e.g. gaskets, etc. Indeed, the seal member 32 can be any component that will circumferentially seal against the inner periphery 14 of a scupper drain 12. Further, the seal member 32 could be supplied as an adhesive or a weld for permanently securing the scupper plug 10 within the scupper drain 12. The seal member 32 is also referred to herein as a first sealing member, while the valve member 30 is also referred to herein as a second sealing member.

Figure 3:
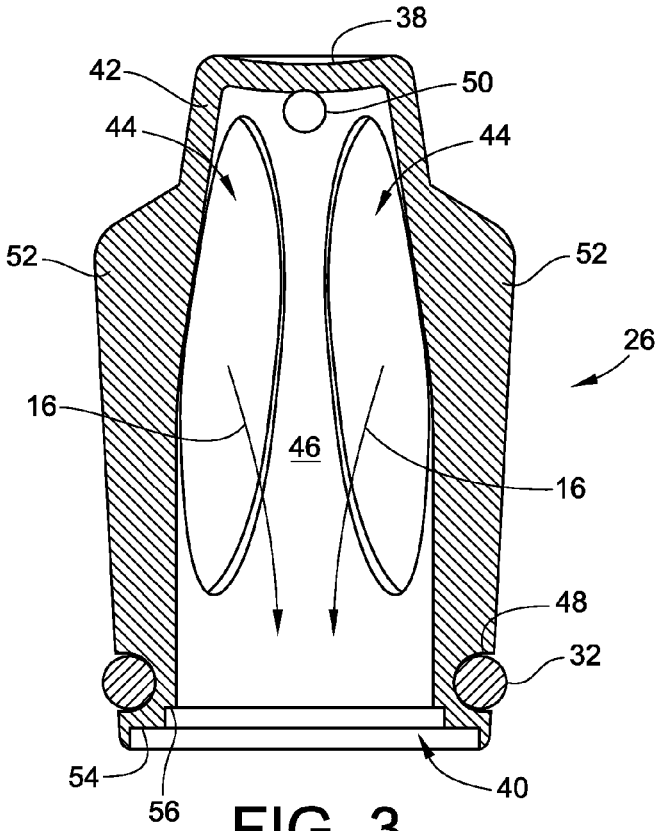
FIG. 3 is a cross sectional view of a frame of the scupper plug of FIG. 1.

Turning now to FIG. 3, the frame 26 generally has an elongated shape with a sidewall 42 that extends between a closed end 38 and an open end 40. The sidewall 42 has a plurality of elliptical openings 44 that allow water to flow from an exterior of the frame 26 into an interior 46 thereof along direction lines 16. Although illustrated as generally elliptical, it is recognized that the openings 44 may take on various other forms in other embodiments, e.g. circular, slotted, perforated, square, etc.

A plurality of ribs 52 extend outwardly from the sidewall 42 of the frame 26. The ribs 52 generally define an outer periphery of the frame 26 that is substantially similar in size to an inner diameter of the scupper drain 12 (see FIG. 1) to reduce the amount of radial play of the scupper plug 10 relative to the scupper drain 12. In the illustrated embodiment, the ribs 52 are integrally formed with the remainder of the frame 26. However, in other embodiments, the ribs 52 may be interchangeable with larger or smaller ribs 52 to accommodate larger or smaller diameters of scupper drains 12 (see FIG. 1).

The sidewall 42 also has a seal carrying groove in the form of seal channel 48. The seal channel 48 is dimensioned to receive a portion of the seal member 32 as illustrated in FIG. 3. The seal channel 48 is located proximate to the open end 40. However, in other embodiments, the seal channel 48 can be located anywhere along the sidewall 42 below the openings 44 and still effectively carry the seal member 32 and provide the desired seal. In the illustrated embodiment of FIG. 3, the seal channel 48 has a generally circular profile to receive the seal member 32. However, the profile of the seal channel 48 can take other forms depending upon the type of seal member 32 used, e.g. rectangular when the seal member 32 is supplied as a rectangular gasket.

A lanyard aperture 50 is also formed in the sidewall 42. The lanyard aperture 50 allows a lanyard, e.g. a rope or similar component, to be affixed to the closed end 38 of the frame 26 thereby allowing it to be more easily removed from a scupper drain 12 (see FIG. 1) when the scupper plug 10 is installed therein.

The frame 26 also has an axial face in the form of an annular seal surface 54 and an annular abutment surface 56 (also referred to below as a second axial abutment face) located proximate to the open end 40. The seal surface 54 provides a surface with which the valve member 30 (see FIG. 2) seals against. The abutment surface 56 provides a surface that the valve structure 28 (see FIG. 2) locates against when installed in the frame 26.

Figure 4:
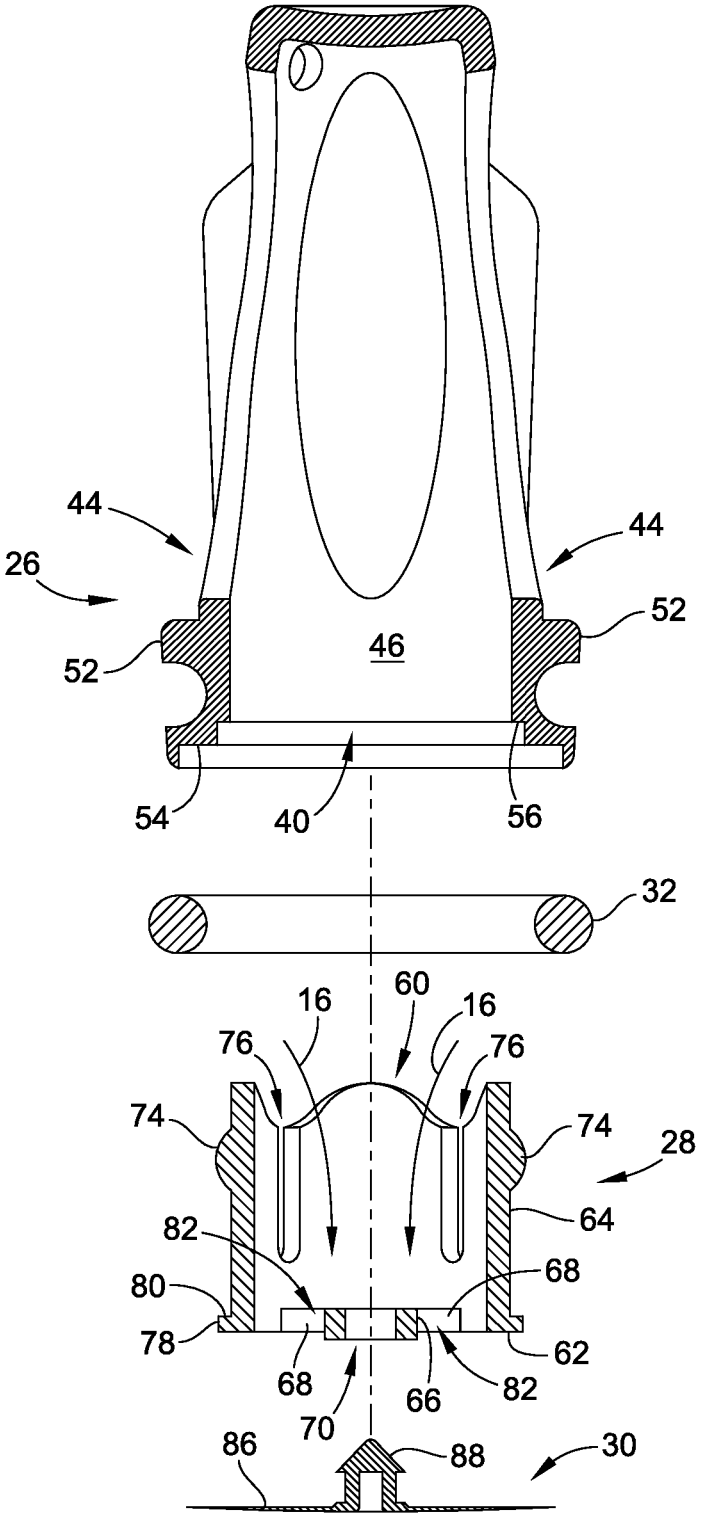
FIG. 4 is an exploded partial cross section of the scupper plug of FIG. 1.

Turning now to FIG. 4, the valve structure 28 has a first end 60, a second end 62, and a sidewall 64 extending therebetween. The first end 60 is generally open to allow water to flow in direction 16 from the interior 46 (see FIG. 3) of the frame 26 towards the second end 62 of the valve support 28.

The second end 62 has a valve retaining structure 66 formed therein. The valve retaining structure 66 has a plurality of radially extending supports 68 that extend to the sidewall 64 and support and locate an aperture 70 at the center of the second end 62 (see also FIG. 2). The aperture 70 is configured to receive a retaining feature 88 of the valve member 30. A plurality of draining apertures in the form of openings 82 are disposed between the plurality of supports 68 to facilitate drainage through the valve structure 28 (see also FIG. 2).

The sidewall 64 has a plurality of slots 76 formed therein. The slots 76 allow the sidewall 64 to resiliently deflect radially inward during installation of the valve structure 28 within the interior 46 of the frame 26 (see FIG. 3). It is recognized that in other embodiments, these slots 76 may be omitted, reduced, or increased in size. It is further recognized that the slots 76 could be embodied as any feature that aids in the ability of the sidewall 64 to elastically deflect during installation.

At least one mounting feature, and in the illustrated embodiment, plurality of nibs 74 extend radially outward from the sidewall 64. The nibs 74 nest within the openings 44 of the frame 26 when the valve structure 28 is fully installed therein. A locating feature in the form of an abutment rib illustrated as lip 78 extends radially outward from the closed end 62 and provides a first axial abutment face in the form of the locating surface 80 that abuts against a second axial abutment face in the form of the abutment surface 56 of the frame 26. Accordingly, the nibs 74 and lip 78 cooperate to locate the valve structure 28 within the interior 46 of the frame 26. The nibs 74 and lip 78 reduce the axial movement of the valve support 28 relative to the frame 26, and generally retain the valve structure 28 at a fixed location relative to the frame when the valve structure 28 is fully installed.

Still referring to FIG. 4, the valve member 30 is generally disc shaped. The retaining feature 88 extends transversely away from a seal surface 86 of the valve member 30. The seal surface 86 contacts the seal surface 54 of the frame 26 and, in some embodiments, the second end 62 of the valve structure 28 to form a seal therewith.

It is recognized that various configurations can embody the valve member 30 and valve support structure 28. As one example, the valve member 30 and valve structure 28 can cooperatively provide a hinged valve member 30 that rotates about a hinge of the valve structure 28. The valve member 30 could also be embodied as a sphere that is biased by a spring carried by the valve structure 28 towards the second 62 thereof. Indeed, multiple configurations are contemplated that will limit the scupper plug to one-way flow therethrough.

Having generally discussed the structural attributes of the scupper plug 10, the following will provide a general discussion of the operation of the same.

Figure 5:
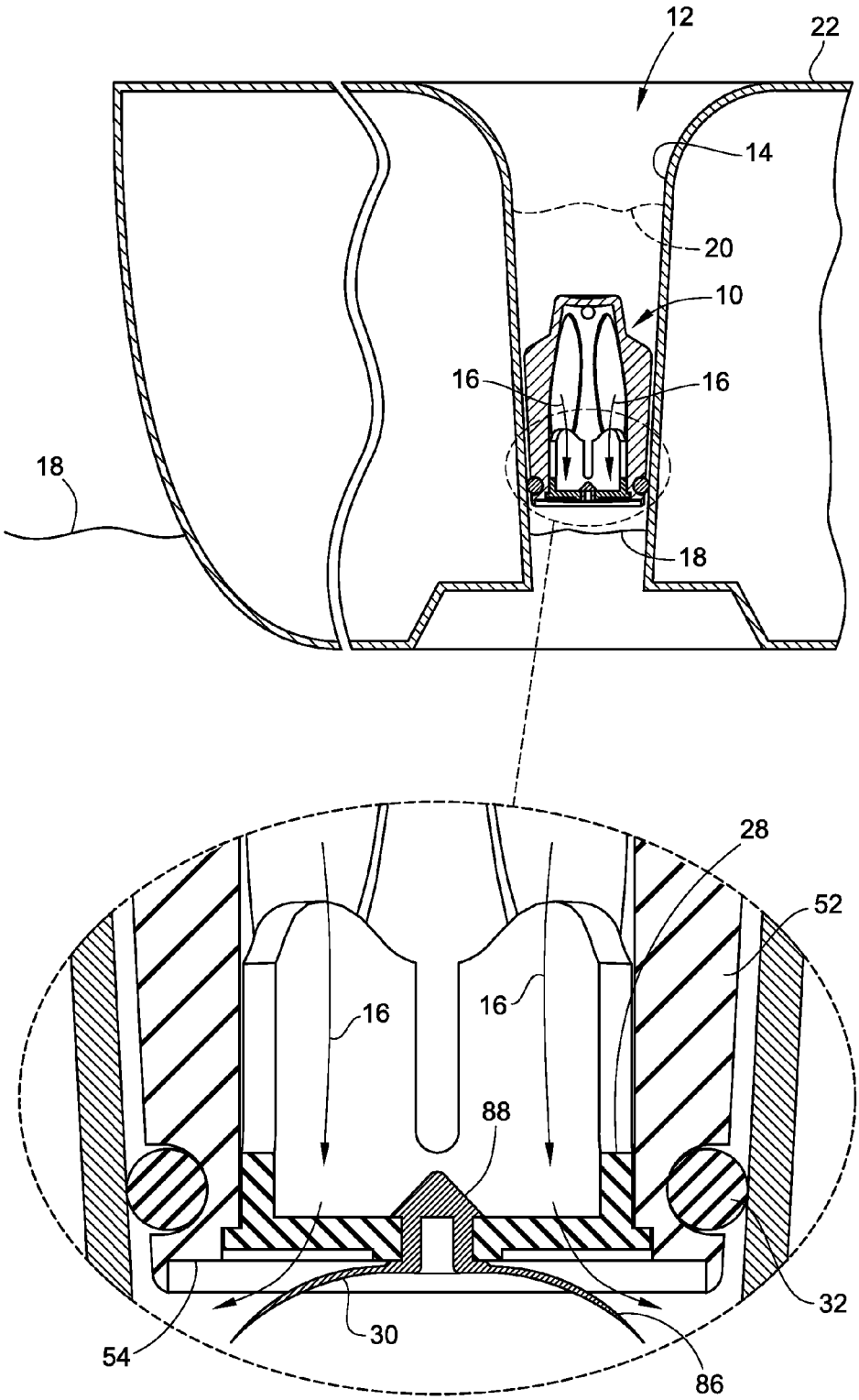
FIGS. 5-9 are cross sectional views of the scupper plug of FIG. 1 under various modes of operation.

Turning now to FIG. 5, the scupper plug 10 is installed in a scupper drain 12 of a kayak 22. The kayak 22 is situated in a body of water creating a water line 18 that surrounds the kayak 22. Water trapped within the scupper drain 12 illustrated by water line 20 will drain through the scupper plug 10 along direction line 16 to ultimately equalize with the water line 18.

More particularly, water illustrated by water line 20 within the scupper drain 12 will cause the valve member 30 to partially deflect thereby breaking the seal between the seal surfaces 54, 86 of the frame 26 and valve member 30 respectively. The valve member 30 will deflect generally as illustrated until the water within the scupper drain 12 has equalized with the water line 18 below the valve member 30. Accordingly, the scupper plug 10 allows water to freely drain therethrough when the water line 18 is generally below the installed scupper plug 10.

Figure 6:
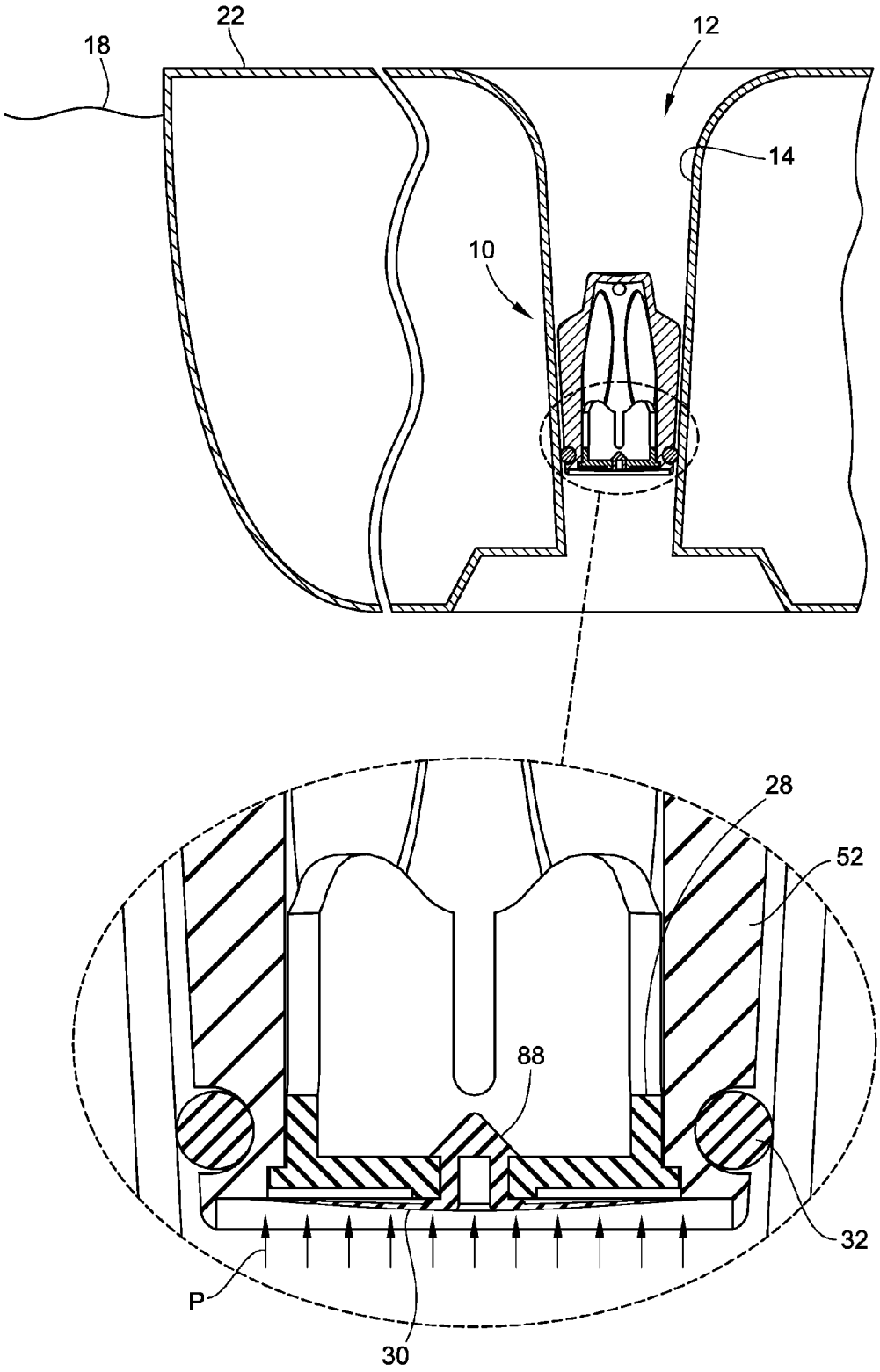

Turning now to FIG. 6, where the water line 18 is above the scupper plug 10 there will be a pressure forcing the valve member 30 against the frame 26, and more particularly forcing the seal surface 86 of the valve member 30 against the seal surface 54 of the frame 26. When this occurs, water cannot flow up through the scupper plug 10 along direction lines 16 to equalize with the water line 18. Accordingly, the scupper plug 10 prevents water that would ordinarily flow back up through the scupper drain 12 and potentially into the seating area of the kayak 22.

Figure 7:
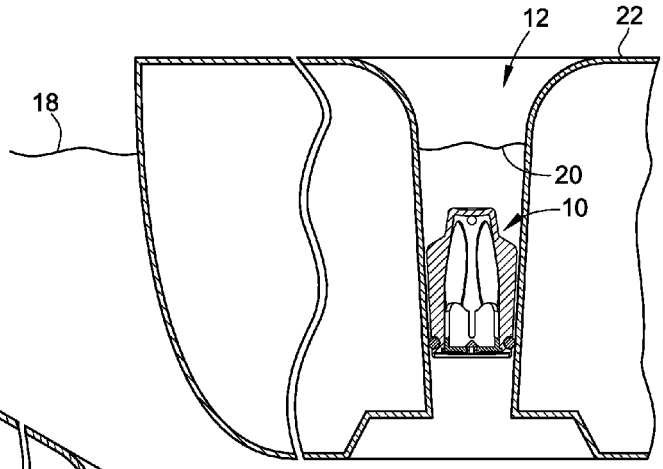

With reference to FIG. 7, a further advantage of the scupper plug 10 is the ability to drain water out of the scupper drain 12 even when the water line 18 exterior to the kayak 22 is generally above the scupper plug 10. As illustrated in FIG. 7, the scupper plug 10 is below the exterior water line 18. Additionally, water has entered into the scupper drain 12 and is represented generally by water line 20. Because the water lines 18, 20 are equalized there will not ordinarily be enough pressure acting against the seal member 32 to break the seal between seal surfaces 54, 86 (see FIG. 5).

Figure 8:
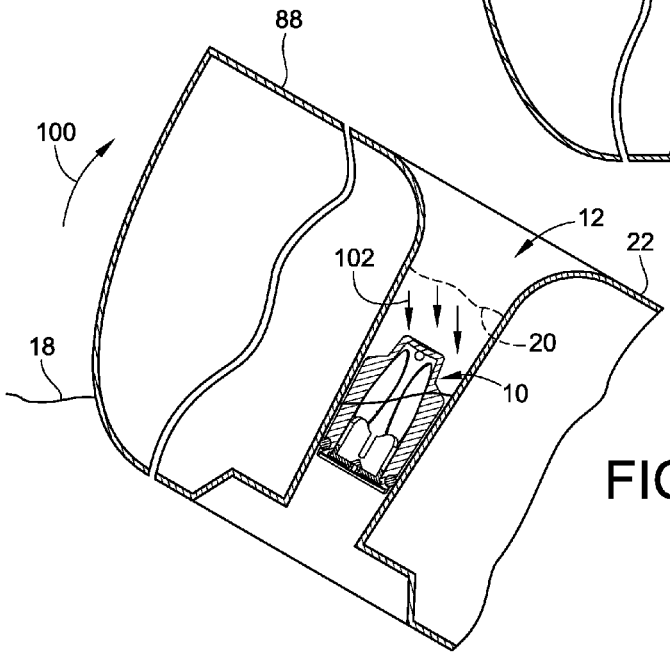

However, and with reference now to FIG. 8, a user can rock the kayak 22 generally in direction 100 causing the water within the scupper drain 12 illustrated as water line 20 to rise above the external water line 18. When this occurs, the water within the scupper drain 12 will drain along direction 102 to equalize with the external water line 18.

Figure 9:
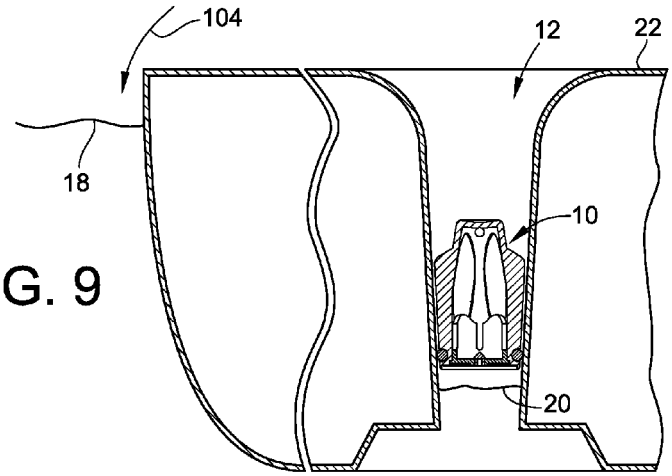

With reference to FIG. 9, when the user moves the kayak 22 back along direction 104, the internal water line 20 will thereafter be below the external water line 18. Accordingly, even where the water trapped within the scupper drain 12 would not ordinarily drain through the scupper plug 10, it is possible to rock the kayak 22 in such a way as to allow further drainage of the same.

As described herein, the scupper plug 10 allows for the advantages of a contemporary scupper drain, while preventing the drawbacks of the same. The scupper plug 10 provides this flexibility in part by incorporating a valve member 30 allows for one way flow through the scupper drain 12 of a kayak 8 or similar watercraft.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A scupper plug for a recreational watercraft, comprising:

a frame including an internal cavity and at least one opening allowing for fluid to pass from an exterior of the frame to the internal cavity;

a valve structure mounted within the internal cavity of the frame;

a valve member mounted to the valve structure;

wherein the valve member is operable to permit fluid to flow from the internal cavity to the exterior of the of the frame in a draining direction and prohibit fluid to enter the internal cavity from the exterior of the frame in a direction opposite the draining direction wherein the at least one opening of the frame includes a plurality of openings formed in a sidewall of the frame, the plurality of openings equally spaced about a circumference of the frame;

wherein the frame has first and second axial ends, the first axial end having an opening formed therein, the second axial end closed, and wherein the sidewall extends between the first and second axial ends; and wherein the valve structure is removable from the frame and includes a mounting feature and a locating feature, the mounting feature received in one of the plurality of openings formed in the sidewall of the frame when the valve structure is installed within the internal cavity of the frame.

2. The scupper plug of claim 1, wherein the locating feature is formed by an abutment rib, the abutment rib including a first axial abutment face, and wherein the frame includes a second axial abutment face, the first axial abutment face abutting the second axial abutment face when the valve structure is installed within the internal cavity of the frame.

3. The scupper plug of claim 2, wherein the mounting feature is received within one of the plurality of openings such that the valve structure is restricted from axial movement relative to the frame in the draining direction when the valve structure is installed within the internal cavity of the frame.

4. The scupper plug of claim 3, wherein the first and second axial abutment faces abut to restrict movement of the valve structure relative to the frame in the direction opposite the draining direction when the valve structure is installed within the internal cavity of the frame.

5. A scupper plug for recreational watercraft, comprising:

a frame having an internal cavity and an opening in an axial face of the frame;

a first sealing member mounted to an circumscribing the frame and configured to form a radial seal with an inner periphery of a scupper drain;

a removable valve structure positioned within the internal cavity of the frame such that a flow path extends from the internal cavity and through the valve structure;

a second sealing member carried by the valve structure, the second sealing member configured to form an axial seal against an axial face of the frame to selectively close the flow path; and wherein the valve structure includes a first end, a second end, and a sidewall extending between the first and second ends, the first end including a valve member receiving aperture and a plurality of draining apertures surrounding the valve member receiving aperture, the flow path extending from the internal cavity through the plurality of draining apertures.

6. The scupper plug of claim 5, wherein the first sealing member is partially received within a seal carrying groove formed in an outer periphery of the frame, such that a portion of the first sealing member extends radially outward from the seal carrying groove.

7. The scupper plug of claim 6, wherein the first sealing member is an o-ring having a generally circular cross sectional profile.

8. The scupper plug of claim 6, wherein the first sealing member is a gasket having a generally non-circular cross sectional profile.

9. The scupper plug of claim 5, wherein the frame has a first axial end and a second axial end, and wherein the first sealing member is mounted to the frame adjacent the first axial end.

10. The scupper plug of claim 5, wherein the valve member is generally disc shaped and includes a valve member retaining feature extending generally perpendicular to a sealing face of the valve member, the valve member receiving aperture receiving the valve member retaining feature such that the valve member selectively closes the flow path by preventing fluid flow in a draining direction through the plurality of draining apertures.

11. The scupper plug of claim 5, wherein the sidewall includes a plurality of open ended slots formed therein such that the sidewall is resiliently flexible radially inward to install and remove the valve structure from the frame.

* * * * *